US005448680A

United States Patent [19]

Kang et al.

[11] Patent Number: 5,448,680

[45] Date of Patent: Sep. 5, 1995

[54] VOICE COMMUNICATION PROCESSING SYSTEM

[75] Inventors: George S. Kang, Silver Spring; Lawrence J. Fransen, Annapolis, both of Md.

[73] Assignee: The United States of America as represented by the Secretary of the Navy, Washington, D.C.

[21] Appl. No.: 839,159

[22] Filed: Feb. 12, 1992

[51] Int. Cl.[6] ..... G10L 7/00

[52] U.S. Cl. ..... 395/2.34; 395/2

[58] Field of Search ..... 395/2, 2.34; 381/41–43, 31, 36

[56] References Cited

U.S. PATENT DOCUMENTS 4,815,134 3/1989 Picone ..... 381/31

5,012,518 4/1991 Liu ..... 381/42

OTHER PUBLICATIONS

Stark, "Introduction to Numerical Methods", Macmillan Publishing Co., Inc., New York, ©1970 by Peter A. Stark, pp. x and 103–110.

Kang et al., "Low-bit rate speech encoders based on line-spectrum frequencies (LSFs)", *Naval Research Laboratory Report* 8857, Jan. 1985.

Analog to Digital Conversion of Voice By 2,400 Bit/-Second Linear Predictive Coding, Nov. 28, 1984, National Communications System Office of Technology & Standards.

Kang et al., "High-Quality 800-b/s Voice Processing Algorithm," NRL Report 9301, Feb. 25, 1991.

Kang, et al., "Error-Resistant Narrowband Voice Encoder," NRL Report 9018, Dec. 26, 1986.

*Primary Examiner*—David D. Knepper

*Attorney, Agent, or Firm*—Thomas E. McDonnell; Edward F. Miles

[57] ABSTRACT

A voice communication processing system and method for processing a speech waveform as a digital bit stream having a reduced number of bits representing speech parameters. The bit representation of amplitude parameters is reduced by storing only probable amplitude parameter transitions corresponding to amplitude parameter indices in an amplitude table and by joint encoding the amplitude parameter indices over multiple frames. The bit representation of the pitch period is reduced by storing a range of pitch periods in a pitch table and by joint encoding pitch period indices corresponding to an average pitch period over two frames. The bit representation of the vocal tract filter coefficients is reduced by storing only probable filter coefficient transitions corresponding to filter coefficient indices in a filter coefficient table and by joint encoding the filter coefficient indices over two frames. Voicing decisions are inferred by an associated vocal tract filter coefficient index obtained by searching the filter coefficient table where the table is divided according to the voicing decisions, and thus separate voicing decisions do not have to be transmitted. By providing a reduced bit representation of the various speech parameters as explained above, the present invention processes the speech waveform at a more efficient data rate. In addition, the present invention converts prediction coefficients (PCs) into line spectra pairs (LSPs) to be used as filter parameters when performing a linear predictive coder (LPC) analysis. Thus, by using LSPs, the present invention is able to more efficiently encode and decode speech.

18 Claims, 12 Drawing Sheets

VOICE COMMUNICATION PROCESSING SYSTEM

BACKGROUND OF THE INVENTION

1. Field of the Invention

The present invention relates generally to a voice communication processing system and, more particularly, to a voice communication processing system and method for processing a speech waveform as a digital bit stream.

2. Description of the Related Art

Digital voice communication is used in a number of applications and has been increasingly used in military communications to provide high-security transmission of speech. Voice communication systems therefore have been implemented which transmit digitized speech at 2400 bits per second over a single channel. Such a 2400 bits per second system is currently deployed with a linear predictive coder. However, a more efficient and effective (error free) data transfer rate for speech signals with similar quality as the 2400 bits per second systems, for example, 800 bits per second, is desirable.

A voice communication system which processes and transmits intelligible speech at a more efficient data rate, such as 800 bits per second, would provide a number of advantages not currently available. For example, increased tolerance to channel bit errors could be provided. Conventionally, the intelligibility of the 2400 bits per second linear predictive coder degrades quickly in the presence of bit errors during transmission. Providing a voice communication system with a data transfer rate of 800 bits per second which has similar quality of a 2400 bits per second speech signal would allow for the addition of error protection coding to be added to the 800 bits per second speech data for transmission at 2400 bits per second and would thus increase the tolerance to bit errors at existing transmission speeds.

Additionally, a more efficient data rate would allow a low probability of intercept (LPI) to be maintained. With a lower data rate for the same speech signal, speech can be transmitted over channels having a smaller bandwidth and/or each speech segment can be transmitted in a shorter period of time on a conventional 2400 bits per second channel. For this reason, a very low data rate is an indispensable element of an LPI voice system. Currently, a great deal of effort is in progress to implement LPI voice terminals.

Also, a more efficient data rate would allow for voice/data integration. Recently, voice/data integration has drawn a great deal of attention. The use of an 800 bits per second voice encoding system would allow integration of voice and data over a single 2400 bits per second channel. For example, visual aids, such as written text or drawings, could be transmitted along with the voice data to enhance communicability.

Finally, a more efficient data rate would allow for voice multiplexing or, voice/voice integration. Currently, a single voice signal can be transmitted over a 3 kHz narrowband channel. If an 800 bits per second voice processor is used, however, three independent voice signals could be multiplexed and transmitted over a single narrowband 2400 bits per second channel. This multiplexing capability would permit secure conferencing, that is, three speakers at one site could communicate with three speakers at another site. Conventionally, secure conferencing has required a conference director to moderate the traffic flow by designating which party can talk, which is not a practical solution to conferencing objectives. With voice multiplexing, however, it would become possible to transmit three individual voices independently over a single channel. As a result, all participants can hear each other, even if two people accidentally talk at the same time. The provision of a voice communication system having a more efficient data rate for a speech signal, for example, 800 bits per second, is desirable to accomplish all of the above features.

SUMMARY OF THE INVENTION

An object of the present invention is to provide voice communication processing at an improved or more efficient data rate.

Another object of the present invention is to provide a reduced number of bits for representing speech parameters in the encoding and decoding of a transmitted digital bit stream.

Still another object of the present invention is to provide a voice communication processing system capable of processing multiple voices at once.

Another object of the present invention is to provide a voice communication processing system capable of transmitting data along with a digital voice representation in a digital bit stream.

Yet another object of the present invention is to provide a voice communication processing system capable of providing error protection redundancy.

Still another object of the present invention is to provide a voice communication processing system capable of maintaining a low probability of intercept.

A further object of the present invention is to provide a voice communication processing system having an 800 bits per second data rate.

The above and other objects can be attained by providing a voice communication processing system and method for processing a speech waveform as a digital bit stream having a reduced number of bits representing speech parameters such as amplitude, pitch period and filter coefficients. The bit representation of amplitude parameters is reduced in number by storing only probable amplitude parameter transitions corresponding to amplitude parameter indices in an amplitude table and by joint encoding the amplitude parameter indices over two frames. The bit representation of pitch period is reduced in number by storing a range of pitch periods in a pitch table and by joint encoding pitch period indices corresponding to an average pitch period over two frames. The bit representation of vocal tract filter coefficients is reduced in number by storing only probable filter coefficient transitions corresponding to filter coefficient indices in a filter coefficient table and by joint encoding the filter coefficient indices over two frames. A voicing decision is inferred by an associated vocal tract filter coefficient obtained by searching the filter coefficient table, and thus a separate voicing decision does not have to be transmitted. By providing a reduced bit representation of the various speech parameters as explained above, the voice communication processing system processes the speech waveform at a more efficient data rate.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 11(*e*) is an illustration of the roots of the LPC analysis filter, and the sum and difference filters in the z-plane;

DESCRIPTION OF THE PREFERRED EMBODIMENTS

Figure 1:
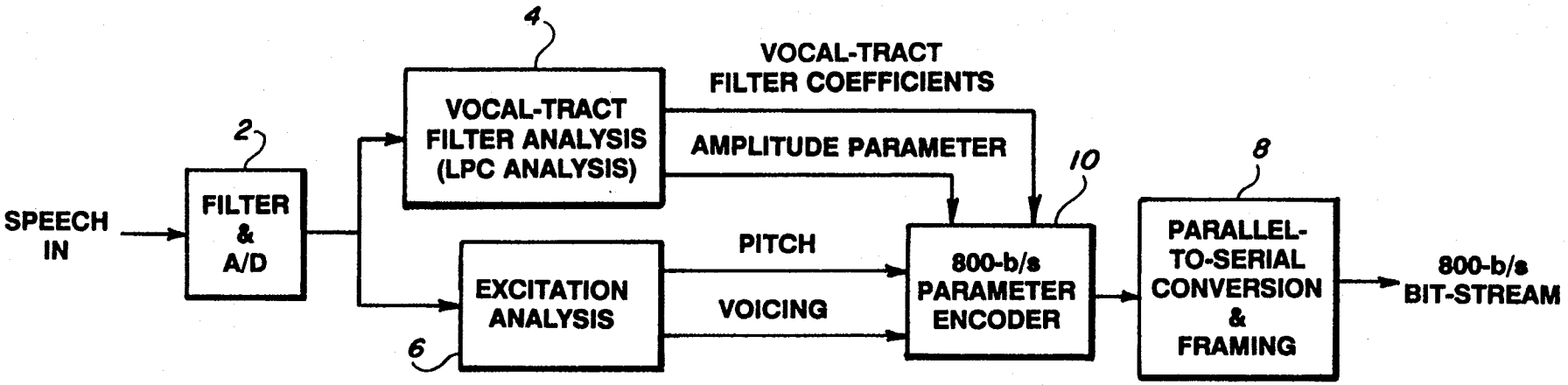
FIG. 1 is a block diagram of a transmitter in the present invention.
Figure 2:
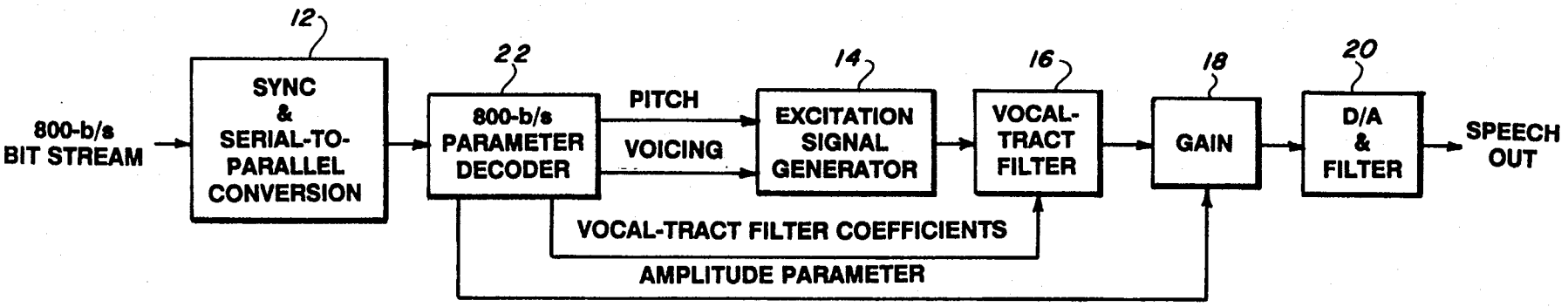
FIG. 2 is a block diagram of a receiver in the present invention.

FIGS. 1 and 2 are block diagrams of the transmitter and receiver, respectively, in the voice communication processing system of the preferred embodiment of the present invention. In FIG. 1, a filter and A/D converter 2, a vocal tract filter analysis unit 4, an excitation analysis unit 6, and a parallel-to-serial conversion and framing unit 8 are conventional, and as described in Federal Standard 1015 are used for linear predictive coding (LPC). The LPC analysis of the unit 4 can performed using the conventional approach described in NRL Report 9018 (1986) incorporated by reference herein. However, it is preferred that the LPC analysis be performed in accordance with a real-root removed sum and difference filtering method described later in detail which is also described in NRL Report 9301 (1991) incorporated by reference herein. An 800 bits per second parameter encoder 10, however, which receives the vocal tract filter coefficients, amplitude parameters, pitch periods and voicing decisions as provided by the conventional system, is designed to encode the speech signal with a reduced bit representation, as will be described, so as to obtain a bit stream with a data rate of 800 bits per second.

In FIG. 2, the synchronous and serial-to-parallel converter unit 12, excitation signal generator 14, vocal tract filter 16, gain 18 and D/A converter and filter 20 are also conventional, and as described in Federal Standard 1015. The 800 bits per second parameter decoder 22, however, which produces the pitch periods, voicing decisions, vocal tract filter coefficients and amplitude parameters, is designed to decode an 800 bits per second bit stream based on the reduced bit representation, as will be described.

Figure 3:
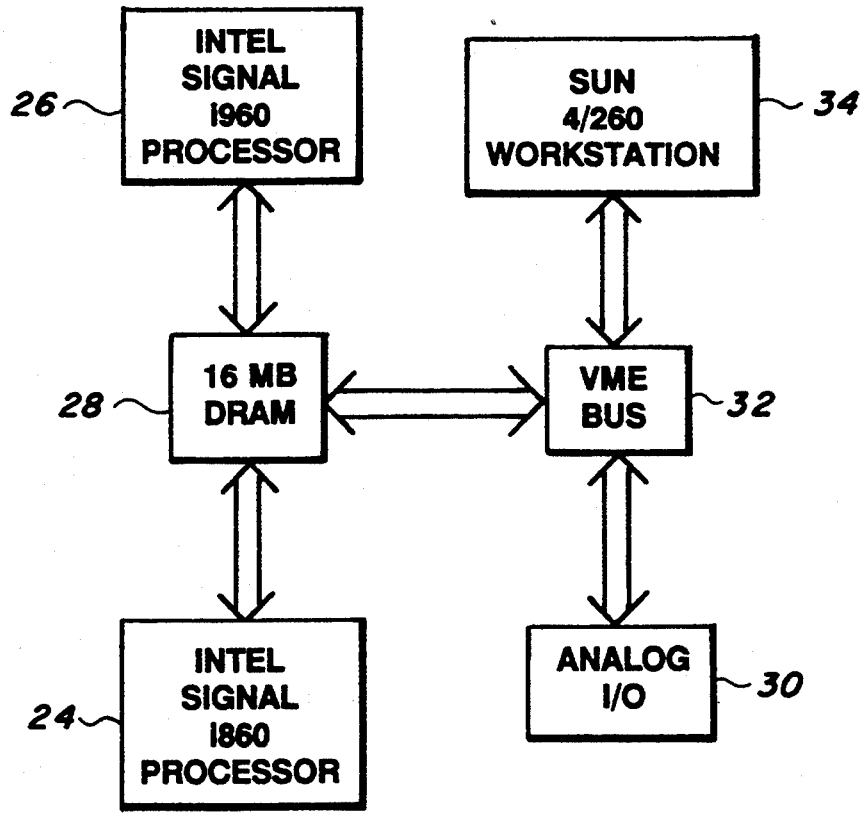
FIG. 3 is a block diagram of a signal processor for implementing an encoder and decoder in the present invention.

FIG. 3 is a block diagram of a signal processor for implementing the encoding, decoding, or both encoding and decoding operations on the 800 bits per second bit stream, as performed by the parameter encoder 10 and parameter decoder 22. An INTEL i860 signal processor 24 is manufactured by INTEL and is the key element in the implementation of the invention. The INTEL i860 signal processor is capable of performing 40 million integer instructions per second and 80 million floating point operations per second. An INTEL i860 processor can handle four independent 800 bits per second channels. Other commercial processors could also serve this function, such as the Texas Instruments C30 and C40 signal processors, or the Motorola 96002 signal processors.

The INTEL i860 signal processor is supplemented by the INTEL i960 processor 26, which performs input-/output operations. Many other processors are commercially available which could perform the equivalent function. The processors 24 and 26 are connected to a 16 MB dynamic random access memory (DRAM) 28. The 16 MB DRAM 28 stores the look-up tables which index the speech parameters of the speech waveform, as will be described, and also stores the program for executing the searches and look-up operations necessary to reference the indices of the speech parameters, as will also be described.

A conventional analog I/O unit 30 is provided, which converts the analog speech waveform into a bit stream and a bit stream into an analog waveform. There are many commercially available integrated circuits which can perform this function. A conventional VME bus 32 connects the processors 24 and 26 to the analog I/O unit 30 for access to the analog I/O facilities via the 16 MB DRAM. A Sun 4/260 workstation 34 is also provided and connected to the system via the VME bus 32. The Sun 4/260 workstation 34 hosts the software development environment. The workstation 34 is necessary only to develop and compile the software developed to perform the 800 bits per second processing, as will be described.

Figure 4:
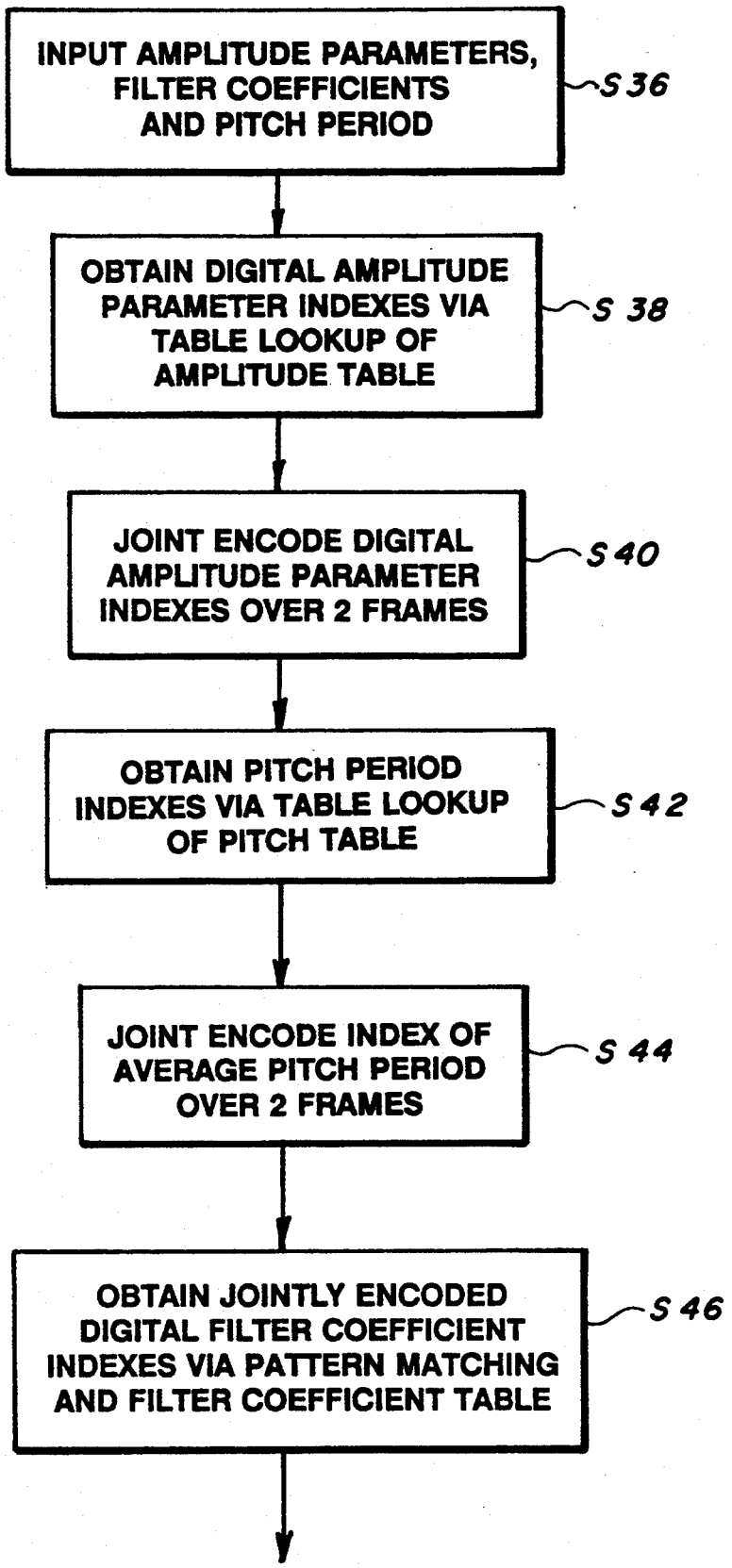
FIG. 4 is a flowchart of the operation of the encoder 10.
Figure 5:
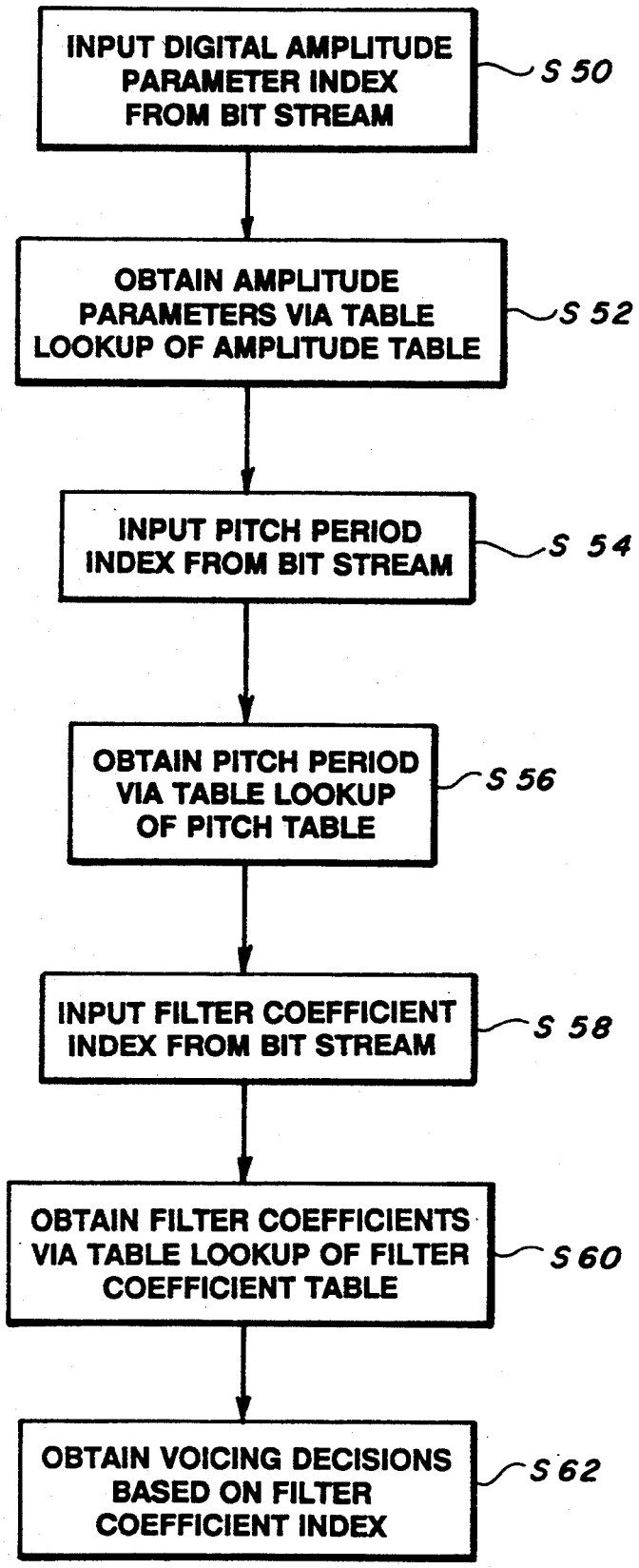
FIG. 5 is a flowchart of the operation of the decoder 22.

FIGS. 4 and 5 are flowcharts showing the general operation of the encoder 10 and decoder 22, respectively, as is implemented by the software executed by the signal processor shown in FIG. 3. In FIG. 4, the operation of the encoder 10 is shown. The amplitude parameters, pitch periods and filter coefficients are input (S36) from the vocal tract filter analysis unit 4 and excitation analysis unit 6. Digital amplitude parameter indices are obtained (S38) via a table look-up in an amplitude table. The digital amplitude parameter indices are joint encoded (S40) over two frames, as will be explained, and output to the parallel to serial conversion and framing unit 8 to be sent within the 800 bits per second bit stream. In the-preferred embodiment, a frame size of 20 ms is chosen. Digital pitch period indices are obtained (S42) via a table look-up in a pitch table and an index of an average of the digital pitch period is joint encoded (S44) over two frames sent within the 800 bits per second bit stream, as will be explained. Jointly encoded digital filter coefficient indices are obtained (S46) via a conventional pattern matching method with reference to a filter coefficient table. Specifically, the digital filter coefficient indices are joint encoded over two frames to be sent within the 800 bits per second bit stream, as will be explained.

FIG. 5 is a flowchart of the general operation of the decoder 22. Digital amplitude parameter index is input (S50) from the bit stream. The amplitude parameters are obtained (S52) via a table look-up in the amplitude table. The pitch period index is input (S54) from the bit stream and the pitch period is obtained (S56) via a table look-up in the pitch table. The filter coefficient index is input (S58) from the bit stream and the filter coefficients are obtained (S60) via a table look-up in the filter coefficient table. Voicing decisions are obtained (S62) by inference based on the filter coefficient index because the table is divided according to the voicing decisions, and thus no transmission of the bit representation of the voicing decisions are necessary.

Figure 6:
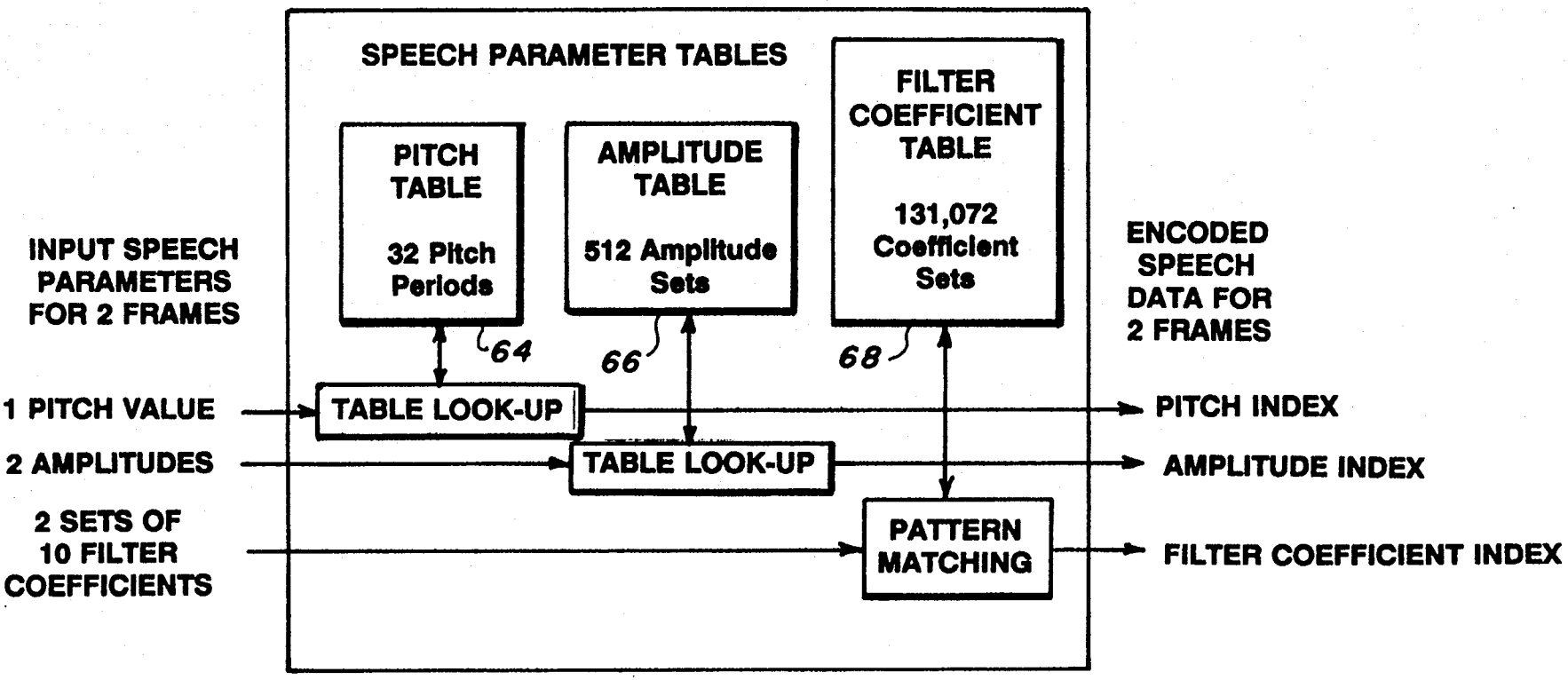
FIG. 6 is an illustration of the encoding process with reference to the look-up tables 64, 66 and 68.
Figure 7:
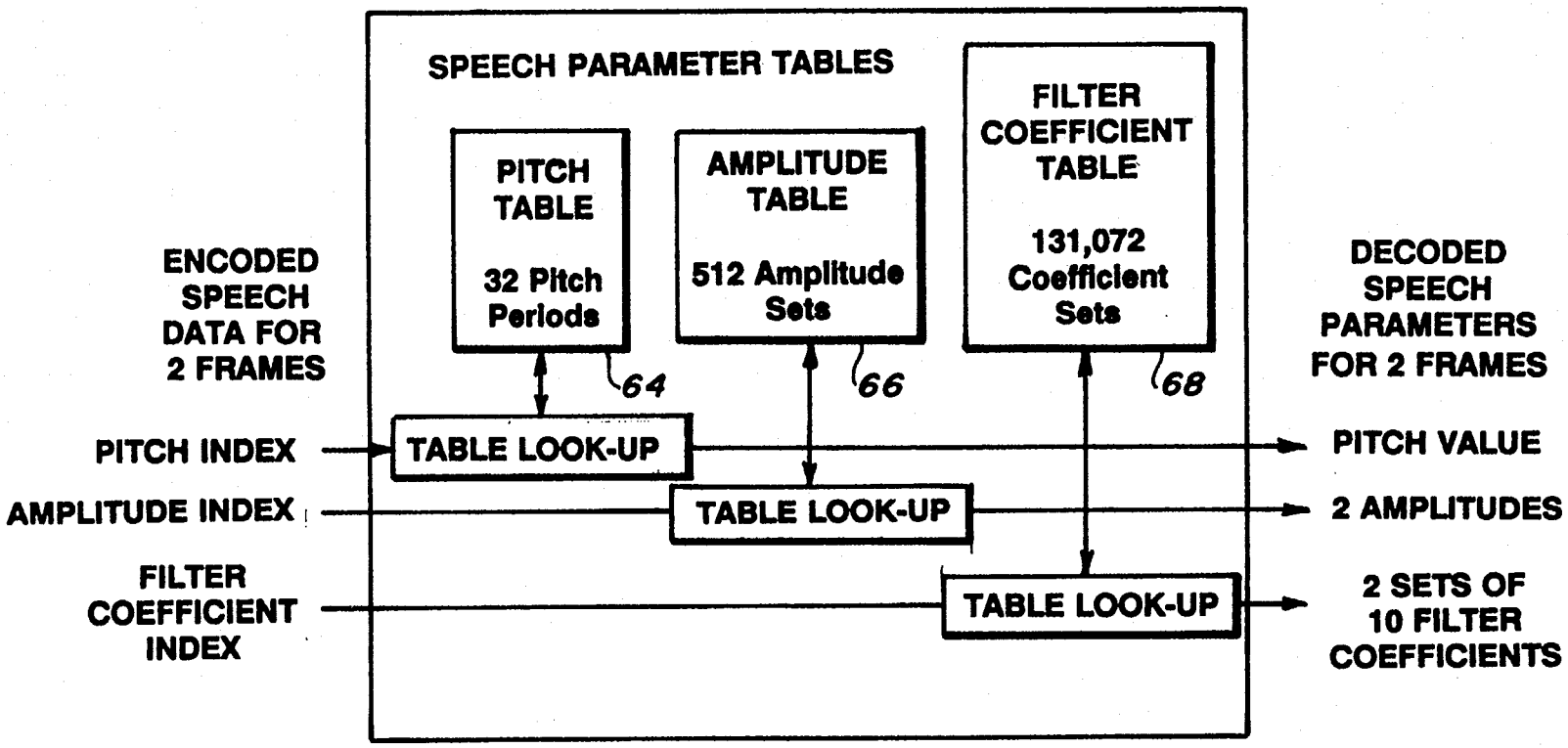
FIG. 7 is an illustration of the decoding process with reference to the look-up tables 64, 66 and 68.

FIGS. 6 and 7 illustrate the encoding and decoding processes performed by the encoder 10 and decoder 22, respectively, with reference to the look-up tables. The pitch table 64 contains 32 pitch periods and the preferred table is shown in Appendix A. During normal conversation, the pitch period does not change as rapidly as other speech parameters. Therefore, only one pitch period (the average pitch period of the first and second voiced frame) is encoded into one of the 32 steps for pitch periods from 20 to 120 speech sampling intervals in the pitch table 64. The pitch resolution is twelve steps per octave. Pitch encoding is a table look-up operation, where, for a given pitch period, the pitch code is read directly from pitch table 64. Pitch decoding is the reverse of this operation.

The amplitude table 66 contains 512 amplitude sets and the preferred table is shown in Appendix B. The amplitude table 66 stores probable amplitude parameters which generate transitions which may occur according to the analysis of a large speech data base. If a voice is generated having transitions with amplitude parameters excluded from the amplitude table 66, the nearest allowable amplitude parameter is selected. The amplitude parameter is the root mean square value of the speech waveform computed for each frame. Initially, each parameter is logarithmically quantized into one of 26 values over the entire dynamic range of the speech signal. Then, two amplitude parameters are jointly (or vectorially) encoded over two consecutive frames into one index. According to extensive analyses of various speech samples, only 512 of the 676 possible amplitude transitions occur with any significance. Thus, the number of bits required to transmit amplitude information can be reduced to 9 bits per 2 frames. Specifically, referring to Appendix B, the allowable amplitude sets of A1 and A2 are $512=2^9$. This means that amplitude information is a 9-bit quantity. Since the two frames A1 and A2 are jointly encoded, the amplitude information is 9 bits per 2 frames. Each of the allowable amplitude transitions is assigned a code in the amplitude table 66, as shown in Appendix B. Amplitude encoding is achieved by a table look-up process. For two logarithmically quantized amplitudes (A1 and A2 in Appendix B) the corresponding code is directly read from the $26\times26$ matrix. Unallowable amplitude transitions (shaded areas) are excluded from the coding space. Decoding is accomplished by the reverse operation, which converts an amplitude code to two amplitudes (A1 and A2) with reference to the amplitude table 66.

The filter coefficient table 68 contains 131,072 line spectrum pair (LSP) sets, a preferred example of which is shown in Appendix C. The filter coefficient table includes a set of line spectrum pairs (LSPs) collected from a large speech database. The number of LSP sets, as shown in the table, is 131,072 ($2^{17}$). Each LSP set contains twenty frequencies, ten frequencies each from two consecutive frames. Thus, each filter coefficient index represents filter coefficients over two frames. That is, each filter coefficient index represents jointly encoded filter coefficients. Example frequency values for the filter coefficient table 68 are shown in Appendix C. The filter coefficient table 68 stores probable filter coefficients in a similar manner as the amplitude table 66 stores only probable amplitude parameters. Such a table can be generated by analyzing a sufficient amount of speech samples and selecting coefficients in accordance with the following three steps:

(1) The first 20 filter coefficients (from two consecutive frames) become the first filter coefficient set to be entered into the table.

(2) The second and subsequent incoming 20 filter coefficients are compared to each entry in the table. If the spectral difference between the incoming 20 filter coefficients and any one of the coefficient sets in the table is less than 2 decibels, the incoming 20 filter coefficients are regarded as being in the same family, and therefore will be discarded. Otherwise, the incoming 20 filter coefficients will be stored as a new entry in the table.

(3) Step (2) is repeated until the maximum allowable template size ($2^{17}$ or 131,072) is reached.

By storing the filter coefficient sets in a tree arrangement, it becomes necessary to only search through a fraction of the filter coefficient sets during the encoding process. The filter coefficient sets are first partitioned based on the voicing decisions of the two consecutive frames, as shown in Appendix D. V1 represents the voicing decision of the first frame (0 or 1) and V2 represents the voicing decision of the second frame (0 or 1).

In case 1 of Appendix D, both frames are unvoiced (V1=V2=0). For this case, approximately 1,000 filter coefficient sets (templates) are necessary to represent possible cases of fricatives, plosives, and silence that can occur within this category. Thus, 1,024 templates can be provided and searched exhaustively to find the best matched template.

In case 2, the first frame is voiced and the second frame is unvoiced (V1=1, V2=0). In this case, approximately 2,000 templates are possible. Thus, 2,048 templates can be provided to represent all possible trailing ends of words and phrases that occur in this category. These templates can be searched exhaustively until the best matched template is found.

Figure 8:
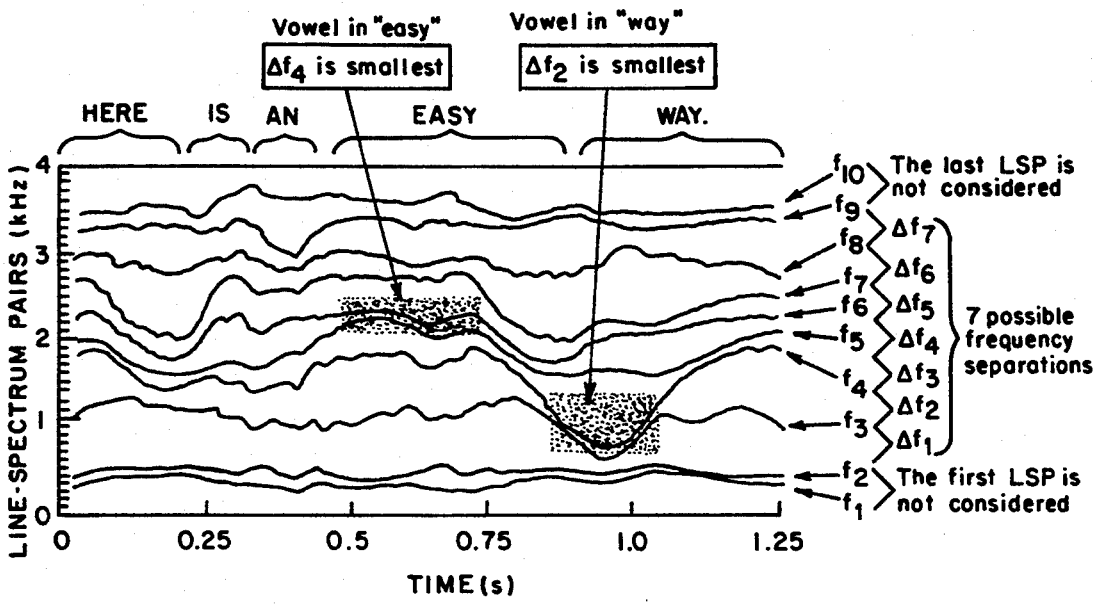
FIG. 8 is an illustration of closely-spaced line spectral frequencies.
Figure 9:
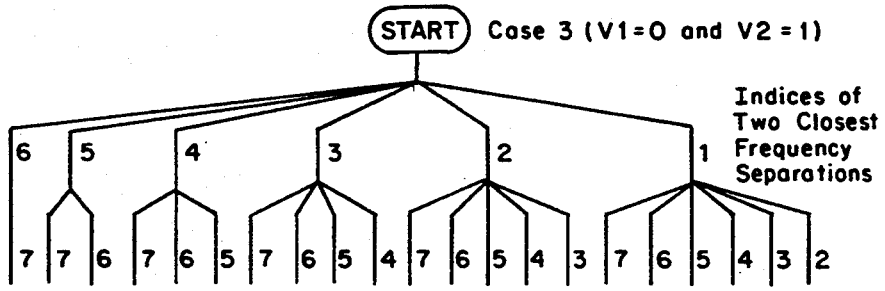
FIG. 9 is an illustration of a tree search of filter coefficient templates for case 3.

In case 3, the first frame is unvoiced and the second frame is voiced (V1=0, V2=1). Approximately 16,000 templates are necessary to represent all possible speech onsets in this critical category. These templates are thus further conventionally partitioned based on the indices of seven closely-spaced line spectral frequencies. As shown in FIG. 8, closely-spaced line spectral frequencies vary from phoneme to phoneme. By clustering filter coefficient templates in terms of indices of closely-spaced line spectral frequencies, templates are grouped in terms of similar speech sounds. FIG. 9 illustrates a search tree of filter coefficient templates in this category.

In case 4, both frames are voiced (V1=1, V2=1). Approximately 110,000 filter coefficient templates are necessary to represent possible vowels in this category.

Figure 10:
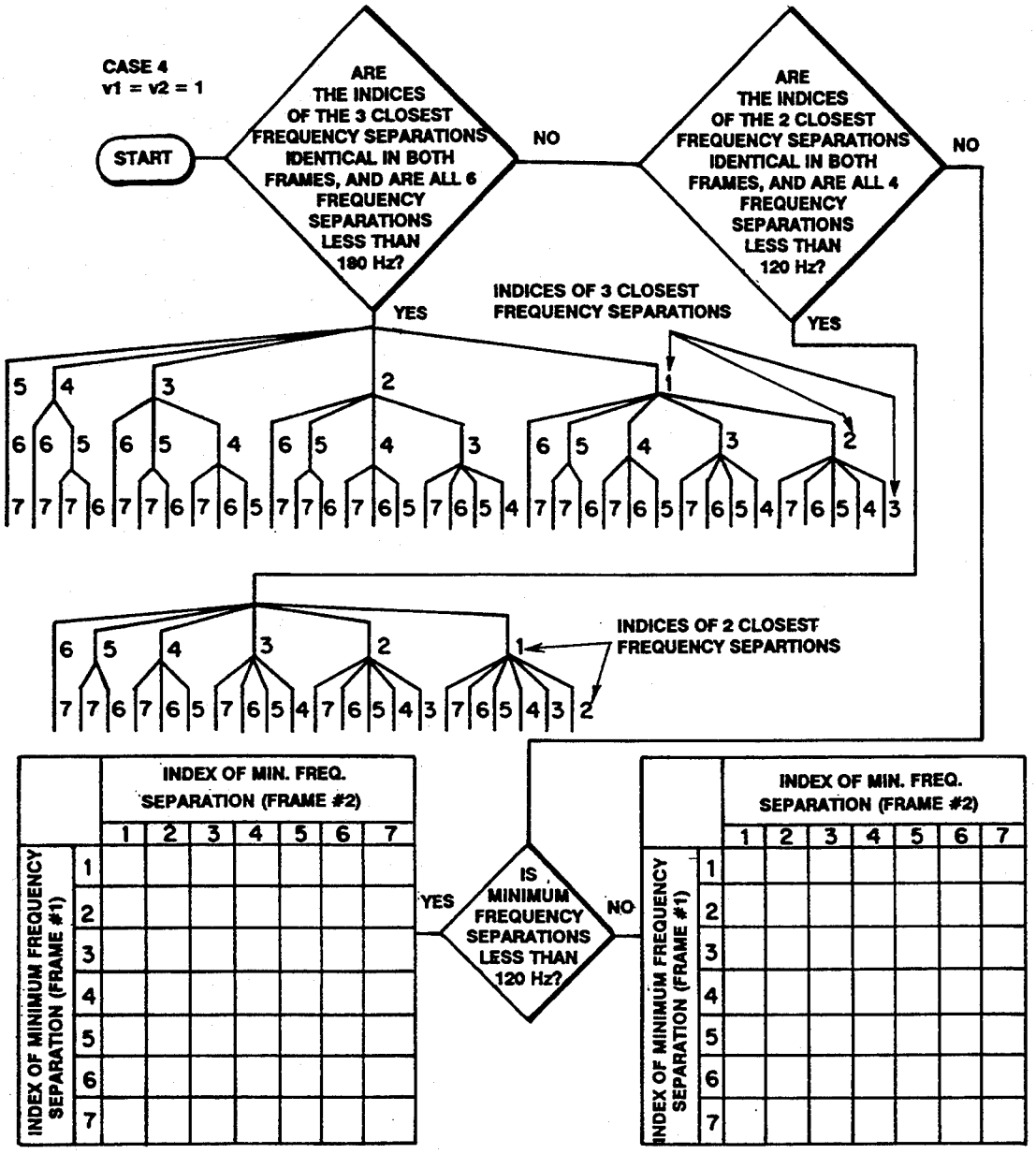
FIG. 10 is an illustration of partitioning templates based on the stationarity of line spectral frequencies over two frames for case 4.

Thus, 111,616 templates are provided and further partitioned based on the stationarity of line spectral frequencies over two frames, as shown in FIG. 10. If the speech is a sustained vowel over the two frames, the indices of the closely-spaced frequency separations will be identical in both frames. For transitional vowels, the indices are expected to be different, and they will be partitioned into a two-dimensional matrix of 7×7 elements using the index of the minimum frequency separation from each frame.

It should also be noted that, by virtue of initially partitioning the filter coefficient table 68 based on the voicing decision, as illustrated in Appendix D, the voicing decision can be readily obtained in the decoding process by the 800 bits per second decoder 22, by reference to the filter coefficient table 68. Thus, the voicing decision bit does not have to be encoded and transmitted.

By virtue of joint encoding the speech parameters over multiple frames, reducing the bit representation of speech parameters by storing only probable transitions, and partitioning the filter coefficient table with reference to the voicing decision and independent speech characteristics as described above, the present invention provides voice processing at a highly efficient rate. In the reduced bit representations described for the preferred embodiment above, the number of bits required to transmit amplitude parameter data is reduced to 9 bits per two frames, the number of bits required to represent the vocal tract filter coefficients is reduced to 17 bits per two frames, and only 5 bits per two frames are required to transmit the pitch. Since the voicing decisions can be inferred from the vocal tract filter coefficient index, no bits have to be transmitted to reproduce the voicing decisions. In accordance with the reduced representation thus provided, a speech signal data transfer rate of 800 bits per second can be attained. It should also be noted that while this preferred embodiment discloses joint encoding of the above parameters over two frames, the joint encoding may be performed over three or more frames, as well.

In addition to the above methods specified for providing an 800 bits per second speech signal transmission rate, the present invention also uses line spectrum pairs (LSPs) as filter parameters when performing the linear predictive coder (LPC) analysis in the vocal tract filter analysis unit 4. LSPs have been gaining interest because their intrinsic properties permit efficient encoding. For example, an error encountered in one member of the LSPs only affects the spectrum near that frequency.

LSPs are obtained by transforming the prediction coefficients generated by linear predictive analysis. In linear predictive analysis, a conventional speech sample is represented as a linear combination of past samples. It is well known that prediction coefficients may be used to generate intelligible speech at a typical data rate of 2400 bits per second. Thus, $$x_i = \sum_{k=1}^{10} \alpha(k)\, x_{i-k} + \epsilon_i \tag{1}$$

where $x_i$ is the i-th speech sample, $\alpha(k)$ is the k-th prediction coefficient (PC), and $\epsilon_i$ is the i-th error (prediction residual) sample. Equation (1) states that $x_i$, the i-th speech sample is a weighted sum of the 10 past samples. The LPC analysis filter, A(z), that transforms speech samples to residual samples (i.e., the difference or error between the actual and predicted speech samples) is obtained by z-transforming equation (1) and solving for the output E(z) over the input X(z). Thus, A(z) is expressed by $$A(z) = 1 - \sum_{k=1}^{10} \alpha(k)\, z^{-k} \text{ [LPC Analysis Filter]} \tag{2}$$

where $z^{-k}$ is a k-sample delay operator. See FIG. 11(*a*).

Figures 11A, 11B, 11C, 11D, 11E:
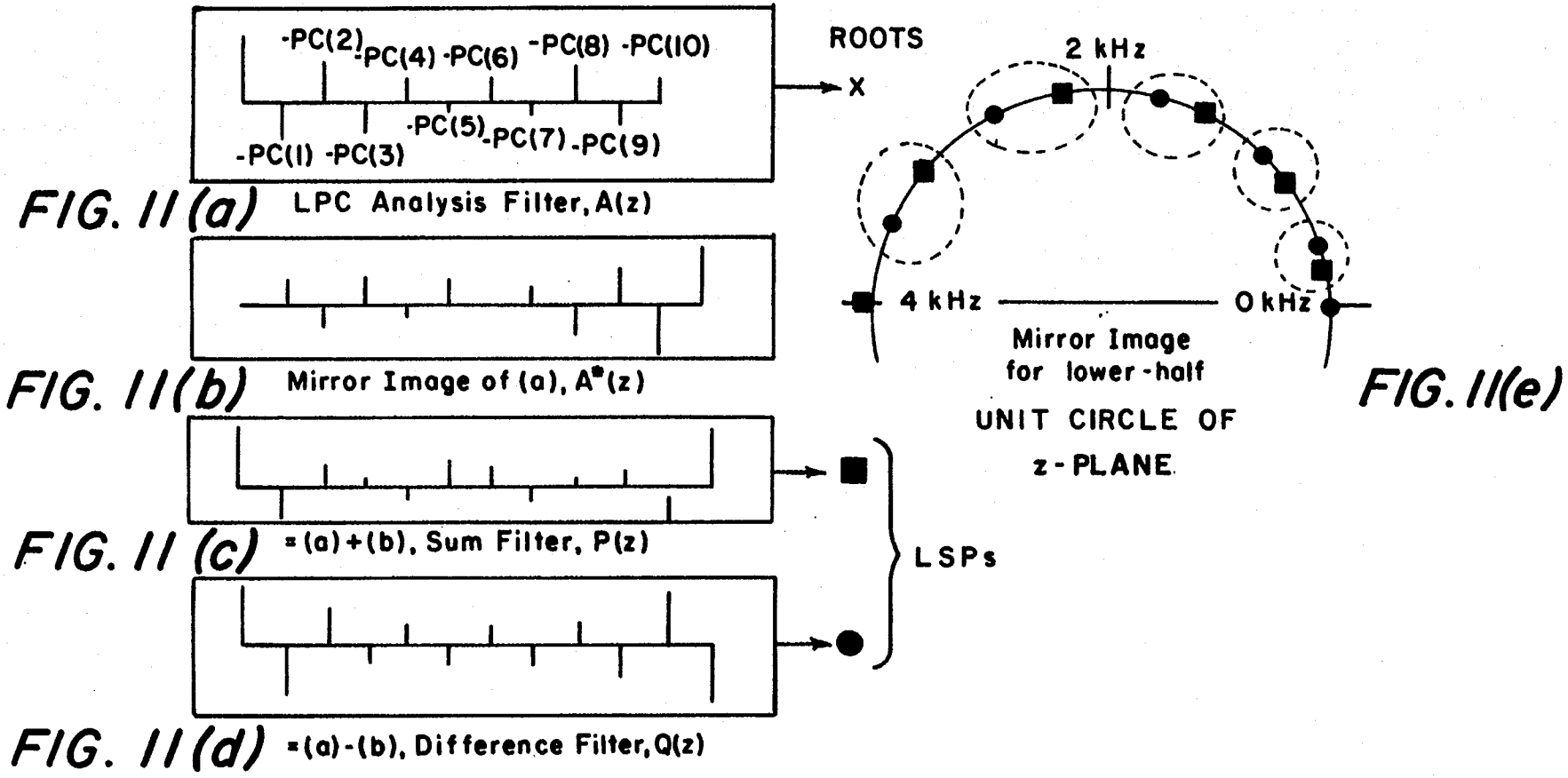
FIGS. 11(*a*)–11(*d*) are illustrations of the LPC analysis filter, A(z), the conjugate A*(z) and sum and difference filters P(z) and Q (z) in the frequency domain.
Figure 12:
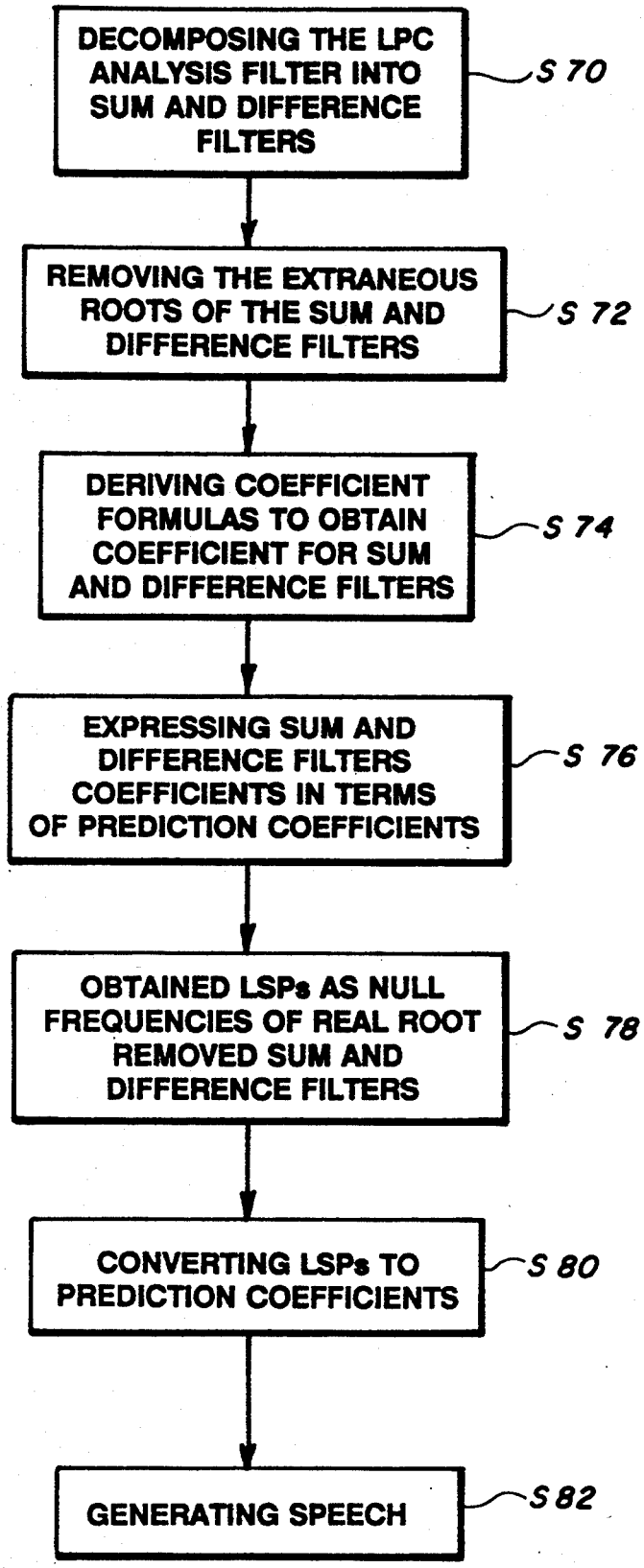
FIG. 12 is a flowchart describing the prediction coefficient to line spectral frequency conversion process.

A(z) may be conventionally decomposed into a set of two transfer functions, one having an even symmetry and the other having an odd symmetry. See FIG. 12, step (S70). This can be accomplished by taking a difference and sum between A(z) and its conjugate function A(−z), typically expressed as A*(z). A*(z) is the transfer function of the LPC analysis filter whose impulse response is a mirror image of A(z), i.e., horizontally flipped with respect to the time origin. A*(z) must then be right-shifted by 11 samples which is shown in FIG. 11(*b*). Thus, $$P(z) = A(z) + z^{-11} A^*(z) \text{ [Sum Filter]} \tag{3}$$

and $$Q(z) = A(z) - z^{-11} A^*(z) \text{ [Difference Filter].} \tag{4}$$

Appendix E lists the coefficients or amplitude values of both the sum and difference filters.

The impulse response of the sum filter P(z) has an even symmetry with respect to its midpoint (see Appendix E or FIG. 11(*c*)). The filter has six roots along the unit circle, as indicated by small squares in the z-plane shown in FIG. 11(*e*). A real root located at 4 kHz is extraneous. The frequencies corresponding to these roots are upper LSP frequencies.

The impulse response of the difference filter Q(z) has an odd symmetry with respect to its midpoint (see Appendix E or FIG. 11(*d*)). The filter also has six roots along the unit circle, as indicated by small circles in the z-plane shown in FIG. 11(*e*). A real root at 0 Hz is extraneous. The frequencies corresponding to these roots are lower LSP frequencies.

The LPC analysis filter, reconstructed by the use of these two filters, i.e., adding the sum and difference filters, is $$A(z) = (\tfrac{1}{2})[P(z) + Q(z)] \text{[LPC Analysis Filter]} \tag{5}$$

in which the roots of P(z) and Q(z) are LSPs. The amount of computation required to convert the PCs to LSPs is substantial. Any root-finding technique that relies on convergence of the solution is not recommended for real-time voice encoding because it is difficult to estimate the computation time since the number of iterations to obtain a solution varies significantly from one coefficient set to another.

In the past various methods of converting from prediction coefficients (PCs) to LSPs have been studied. The method of the present invention, different from the past methods, requires a fixed amount of computation for each conversion. The method can be implemented for real-time operation using Texas Instruments' TMS320C25 fixed-point microprocessor and, more preferrably using TMS320C30 floating-point microprocessor and the SKYBOLT (INTEL i860) acceleration board.

LSPs are null frequencies associated with the frequency responses of sum and difference filters, P(z) and Q(z). The null frequencies are obtained by local minima of the frequency responses as the frequency is scanned from 0 to 4 kHz at a 20 Hz step. Each null frequency is refined through a parabolic interpolation by using three consecutive spectral points.

To reduce computations, we first remove the extraneous roots at z=1 and z=−1. Then both the sum and difference filters have even-symmetric impulse responses. Real-root removed sum and difference filters are obtained by factoring the real roots from P(z) and Q(z) using a conventional polynomial division method. See FIG. 12, step (S72). The real roots in P(z) and Q(z) are generated during the summing and differencing operations when deriving P(z) and Q(z). However, these real roots do not contain any information related to speech and therefore can be omitted. Thus P(z) and Q(z) can be expressed by $$P(z)=(1+z^{-1})PP(z) \tag{6}$$

and $$Q(z)=(1-z^{-1})QQ(z). \tag{7}$$

The removal of the real roots reduces the 12-th order polynomials of P(z) and Q(z) to 11-th order polynomials PP(z) and QQ(z), respectively. This reduction in computation is beneficial because speech is generated in real-time requiring millions of computations per second. Thus, this reduction in computation makes the calculation of the sum and difference filters much more efficient.

The coefficients PP(z) and QQ(z) in equations (6) and (7) are the pulse amplitudes shown in FIGS. 11(*c*) and 11(*d*), respectively. These coefficients are listed in Appendix F and are used to compute LSPs since the roots of PP(z) and QQ(z) are the LSPs. The coefficient or amplitude values are listed in Appendix F to eliminate the need for computing the amplitudes using polynomial division for each frame. Therefore, the present invention further reduces the computational procedure by deriving coefficients formulas PP(z) and QQ(z) through polynomial division. See FIG. 12, step (S74). Thus, once the formulas for the coefficients PP(z) and QQ(z) have been derived, the formulas need only be executed in order to obtain the LSPs which eliminates the need for performing polynomial division for each frame. Appendix F lists the results. As noted in the table, the impulse responses of the real-root removed P(z) or Q(z) are respectively even and odd symmetric, and only six values are unique.

Since P(z) and Q(z) are related to prediction coefficients (see Appendix E), PP(z) and QQ(z) can be expressed directly in terms of prediction coefficients by plugging in for the coefficients P(z) and Q(z) in Appendix F with the values of P(z) and Q(z) defined in terms of prediction coefficients listed in Appendix E. See FIG. 12, step (S76). Since PP(z) and QQ(z) can be expressed directly in terms of prediction coefficients, two coefficient conversion steps can be combined into only one step further reducing computation time.

LSPs can be determined by the null frequencies of the amplitude responses of (real-root removed) sum and difference filters (i.e., the frequencies at which the amplitude responses of the sum and difference filters vanish). See FIG. 12, step (S78). A direct Fourier Transform (not Fast Fourier Transform) can be used for computing the spectra based on the first six time samples listed in Appendix G. A frequency step of 20 Hz is adequate.

The amplitude response of the (real-root removed) sum or difference filter is obtained by a direct Fourier transform of the filter impulse response. The spectra of PP(z) and QQ(z) are computed at a 20 Hz interval from 0 to 4000 Hz. To simplify notations, let $\beta=(\pi/4000)(20)$. The amplitude response of PP(z), denoted by PP(k), can be obtained from $$PP(k)=\left\{\sum_{j=1}^{11} PP(j)\cos[\beta(k-1)(j-1)]\right\}^2+\left\{\sum_{j=1}^{11} PP(j)\sin[\beta(k-1)(j-1)]\right\}^2 \quad k=1,2,\ldots 200 \tag{8}$$

where k is the frequency index (k=1 means 0 Hz, k=2 means 20 Hz, . . . ), and j is the time index (j=1 means t=0 s, j=2 means 125 μs, . . . ). Similarly, the amplitude response of QQ(z) ,denoted by QQ(k), can be expressed as $$QQ(k)=\left\{\sum_{j=1}^{11} QQ(j)\cos[\beta(k-1)(j-1)]\right\}^2+\left\{\sum_{j=1}^{11} QQ(j)\sin[\beta(k-1)(j-1)]\right\}^2 \quad k=1,2,\ldots 200. \tag{9}$$

Both PP(z) and QQ(z) are even symmetric (see Appendix G) with six unique time-samples. Thus Eqs. (7) and (8) can be simplified to $$PP(k)=\left\{\sum_{j=1}^{6} PP(j)CT(k-j)\right\}^2+\left\{\sum_{j=1}^{6} PP(j)ST(k,j)\right\}^2 \quad k=1,2,\ldots 200 \tag{10}$$

and $$QQ(k)=\left\{\sum_{j=1}^{6} QQ(j)CT(k-j)\right\}^2+\left\{\sum_{j=1}^{6} QQ(j)ST(k,j)\right\}^2 \quad k=1,2,\ldots 200 \tag{11}$$

where CT (k, j) and ST (k, j) are cosine and sine values expressed by $$CT(k,j) \triangleq \cos[\beta(k-1)(j-1)] + \cos[\beta(k-1)(11-j)] \quad \text{for } j = 1,2,3,4,5 \tag{12}$$
$$\triangleq \cos[\beta(k-1)(j-1)] \quad \text{for } j = 6.$$

and $$ST(k,j) \triangleq \sin[\beta(k-1)(j-1)] + \sin[\beta(k-1)(11-j)] \quad \text{for } j = 1,2,3,4,5 \tag{13}$$
$$\triangleq \sin[\beta(k-1)(j-1)] \quad \text{for } j = 6.$$

The total number of cosine or sine values equals the product of the highest frequency and time indices (i.e., $200\times 6=1200$). Among them, only 400 cosine and sine values are unique for a frequency resolution of 20 Hz and speech sampling rate of 8000 Hz. To make the implementation simpler, however, the entire 1200 cosine and sine values can be stored in sequence.

LSPs are the frequencies at which the amplitude responses of PP(z) or QQ(z) vanish. To determine these frequencies, three consecutive amplitude values ($A_1$, $A_2$, and $A_3$) are subject to a parabolic fitting if the center value is lowest (i.e., $A_2<A_1$ and $A_2<A_3$). The parabolic fitting is used to refine the frequency of the amplitude spectra. Let the equation of a parabola that goes through these three spectral points be expressed by $$A(f)-af^2+bf+c \tag{14}$$

where a, b and c are constants.

Let the coordinates of three consecutive spectral points be denoted by (1, $A_1$), (0, $A_2$), and (−1, $A_3$). Substituting these coordinates into equation (13) gives $$A_1=a+b+c \quad A_2=c \quad A_3=a-b+c. \tag{15}$$

From these three equations, a and b are obtained from $$a=0.5(A_3-2A_2+A_1) \quad b=0.5(A_1-A_3). \tag{16}$$

At the peak or null of the parabola, the first derivative A(f) with respect to frequency must be zero. From equation (13), this frequency is expressed as $$f=b/a. \tag{17}$$

At f=f, the parabola is at the null (not the peak) because the second derivative of A(f) with respect to f (i.e., 2a) is positive because $A_2<A_1$ and $A_2<A_3$ in equation (16).

Substituting equation (15) into equation (16), the null frequency in terms of three consecutive spectral points is expressed as $$f=0.5(A_3-A_1)/(A_1-2A_2+A_3) \text{ for } A_2<A_1 \text{ and } A_2<A_3. \tag{18}$$

Figure 13:
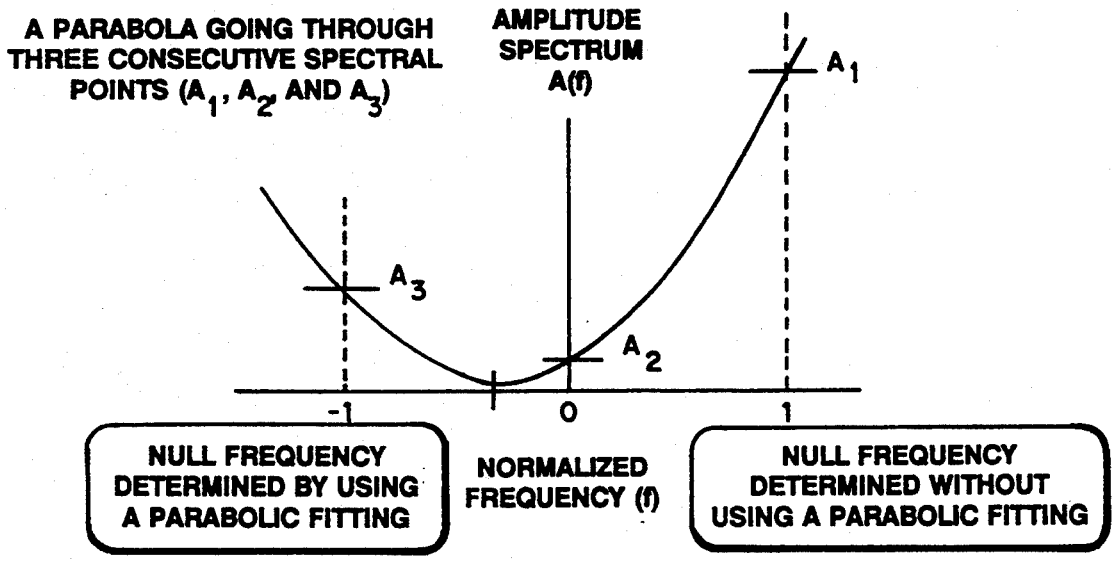
FIG. 13 is an illustration of a parabolic fitting.

Equation (17) is the amount of normalized frequency that must be shifted with respect to the center frequency (see FIG. 13). Since one unit of normalized frequency corresponds to 20 Hz, the amount of frequency that must be shifted from the center frequency is 20 f Hz. Thus, a line spectrum frequency is the sum of the center frequency and 20 f Hz. Thus, using the above described method, PCs may be efficiently converted into LSPs to be used as filter parameters for performing the linear predictive coder analysis in the vocal tract filter analysis unit 4.

Figure 14:
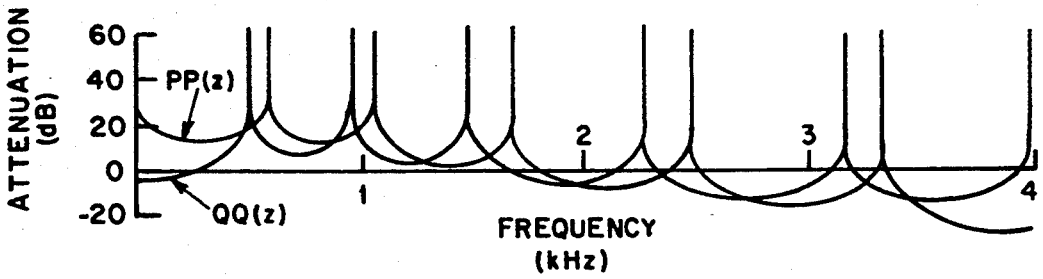
FIG. 14 is an illustration of the roots of PP(z) and QQ(z).

In addition to the above method, LSPs may be converted back into PCs just prior to speech generation at the receiver. See FIG. 12, step (S80). The vocal tract filter 16 in FIG. 2 converts a set of LSPs to a set of PCs. The conversion method can be derived in the following manner. As stated previously, LSPs are the roots of PP(z) and QQ(z), and they are located on the unit circle. The roots of PP(z) and QQ(z) are illustrated in FIG. 14. Both PP ( z ) and QQ ( z ) have five roots and can be expressed in the following factored form:

$$PP(z) = \prod_{k=1}^{5} [1-\exp(j\theta_k)z^{-1}][1-\exp(-j\theta_k)z^{-1}] \tag{19}$$

$$QQ(z) = \prod_{k=1}^{5} [1-\exp(j\theta_k')z^{-1}][1-\exp(-j\theta_k')z^{-1}]. \tag{20}$$

where $\theta_k$ and $\theta'_k$ are normalized LSPs (where one unit of LSP is 4000 HZ). Combining equation (19) with equation (6) produces the transfer function of the sum filter in terms of LSPs as $$P(z) = (1+z^{-1}) \prod_{k=1}^{5} [1-\exp(j\theta_k)z^{-1}][1-\exp(-j\theta_k)z^{-1}] \tag{21}$$

where $\theta_k$ is the location of the lower frequency of the k-th LSP. If a line-spectrum frequency is 0 Hz, then $\theta_k=\pi$rad.

Likewise, combining equations (20) and (7) produces the transfer function of the difference filter as $$Q(z) = (1+z^{-1}) \prod_{k=1}^{5} [1-\exp(j\theta_k')z^{-1}][1-\exp(-j\theta_k')z^{-1}] \tag{22}$$

where $\theta'_k$ is the location of the upper frequency of the k-th LSP.

From equation (4), the transfer function of the LPC analysis filter in terms of the sum and difference filter is $$A(z)=(\tfrac{1}{2})\,[P(z)+Q(z)] \tag{23}$$

which is in the form of $$A(z)=1+\mu_1 z^{-1}+\mu_2 z^{-2}+\mu_{10} z^{-10} \tag{24}$$

where $\mu$'s are new coefficients of A(z). Comparing equation (1) with equation (22) indicates that $$PC(k)=-\mu_k. \tag{25}$$

Thus, in order to reconvert the LSPs back to the prediction coefficients, the prediction coefficients correspond to the coefficients of the transfer function of the LPC Analysis filter A(z). Therefore, PCs can be converted to LSPs in order to remove the real roots from the sum and difference filters P(z) and Q(z) which reduces the computation of generating the LSPs, and which in turn, reduces the computation for estimating received speech. Similarly, LSPs can be reconverted back into PCs to permit the speech to be transmitted to a destination such as a person receiving the message. See FIG. 12, step (S82).

The many features and advantages of the invention are apparent from the detailed specification and thus it is intended by the appended claims to cover all such features and advantages of the invention which fall within the true spirit and scope of the invention, Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

APPENDIX A

| Pitch Period | Pitch Code | Decoded Pitch |
|---|---|---|
| 20 | 0 | 20 |
| 21 | 1 | 21 |
| 22 | 2 | 22 |
| 23 | 3 | 23 |
| 24 | 4 | 24 |
| 25 | 5 | 26 |
| 26 | 5 | 26 |
| 27 | 6 | 28 |
| 28 | 6 | 28 |
| 29 | 7 | 30 |
| 30 | 7 | 30 |
| 31 | 8 | 32 |
| 32 | 8 | 32 |
| 33 | 9 | 34 |
| 34 | 9 | 34 |
| 35 | 10 | 36 |
| 36 | 10 | 36 |
| 37 | 11 | 38 |
| 38 | 11 | 38 |
| 39 | 12 | 40 |

APPENDIX A-continued

| Pitch Period | Pitch Code | Decoded Pitch |
|---|---|---|
| 40 | 12 | 40 |
| 42 | 13 | 42 |
| 44 | 14 | 44 |
| 46 | 15 | 47 |
| 48 | 15 | 47 |
| 50 | 16 | 50 |
| 52 | 17 | 53 |
| 54 | 17 | 53 |
| 56 | 18 | 57 |
| 58 | 18 | 57 |
| 60 | 19 | 60 |
| 62 | 20 | 63 |
| 64 | 20 | 63 |
| 66 | 21 | 67 |
| 68 | 21 | 67 |
| 70 | 22 | 71 |
| 72 | 22 | 71 |
| 74 | 23 | 75 |
| 76 | 23 | 75 |
| 78 | 24 | 80 |
| 80 | 24 | 80 |
| 84 | 25 | 85 |
| 88 | 26 | 90 |
| 92 | 26 | 90 |
| 96 | 27 | 95 |
| 100 | 28 | 101 |
| 104 | 28 | 101 |
| 108 | 29 | 107 |
| 112 | 30 | 113 |
| 116 | 30 | 113 |
| 120 | 31 | 120 |
| 124 | 31 | 120 |
| 128 | 31 | 120 |
| 132 | 31 | 120 |
| 136 | 31 | 120 |
| 140 | 31 | 120 |
| 144 | 31 | 120 |
| 148 | 31 | 120 |
| 152 | 31 | 120 |
| 156 | 31 | 120 |

APPENDIX B

| | A2 | | | | | | | | | | | | | | | | | | | | | | | | | |
|---|---|---|---|---|---|---|---|---|---|---|---|---|---|---|---|---|---|---|---|---|---|---|---|---|---|---|
| A1 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 |
| 1 | 0 | 1 | 2 | 3 | 4 | 5 | 6 | 7 | 8 | 9 | 10 | 11 | 12 | 13 | 14 | 15 | 16 | 17 | 18 | 19 | | | | | | |
| 2 | 20 | 21 | 22 | 23 | 24 | 25 | 26 | 27 | 28 | 29 | 30 | 31 | 32 | 33 | 34 | 35 | 36 | 37 | 38 | 39 | 40 | | | | | |
| 3 | 41 | 42 | 43 | 44 | 45 | 46 | 47 | 48 | 49 | 50 | 51 | 52 | 53 | 54 | 55 | 56 | 57 | 58 | 59 | 60 | 61 | | | | | |
| 4 | 62 | 63 | 64 | 65 | 66 | 67 | 68 | 69 | 70 | 71 | 72 | 73 | 74 | 75 | 76 | 77 | 78 | 79 | 80 | 81 | 82 | 83 | | | | |
| 5 | 84 | 85 | 86 | 87 | 88 | 89 | 90 | 91 | 92 | 93 | 94 | 95 | 96 | 97 | 98 | 99 | 100 | 101 | 102 | 103 | 104 | 105 | | | | |
| 6 | 106 | 107 | 108 | 109 | 110 | 111 | 112 | 113 | 114 | 115 | 116 | 117 | 118 | 119 | 120 | 121 | 122 | 123 | 124 | 125 | 126 | 127 | | | | |
| 7 | 128 | 129 | 130 | 131 | 132 | 133 | 134 | 135 | 136 | 137 | 138 | 139 | 140 | 141 | 142 | 143 | 144 | 145 | 146 | 147 | 148 | 149 | | | | |
| 8 | 150 | 151 | 152 | 153 | 154 | 155 | 156 | 157 | 158 | 159 | 160 | 161 | 162 | 163 | 164 | 165 | 166 | 167 | 168 | 169 | 170 | 171 | | | | |
| 9 | 172 | 173 | 174 | 175 | 176 | 177 | 178 | 179 | 180 | 181 | 182 | 183 | 184 | 185 | 186 | 187 | 188 | 189 | 190 | 191 | 192 | 193 | | | | |
| 10 | 194 | 195 | 196 | 197 | 198 | 199 | 200 | 201 | 202 | 203 | 204 | 205 | 206 | 207 | 208 | 209 | 210 | 211 | 212 | 213 | 214 | 215 | | | | |
| 11 | 216 | 217 | 218 | 219 | 220 | 221 | 222 | 223 | 224 | 225 | 226 | 227 | 228 | 229 | 230 | 231 | 232 | 233 | 234 | 235 | 236 | 237 | | | | |
| 12 | 238 | 239 | 240 | 241 | 242 | 243 | 244 | 245 | 246 | 247 | 248 | 249 | 250 | 251 | 252 | 253 | 254 | 255 | 256 | 257 | 258 | 259 | | | | |
| 13 | 260 | 261 | 262 | 263 | 264 | 265 | 266 | 267 | 268 | 269 | 270 | 271 | 272 | 273 | 274 | 275 | 276 | 277 | 278 | 279 | 280 | 281 | 282 | | | |
| 14 | 283 | 284 | 285 | 286 | 287 | 288 | 289 | 290 | 291 | 292 | 293 | 294 | 295 | 296 | 297 | 298 | 299 | 300 | 301 | 302 | 303 | 304 | 305 | | | |
| 15 | 306 | 307 | 308 | 309 | 310 | 311 | 312 | 313 | 314 | 315 | 316 | 317 | 318 | 319 | 320 | 321 | 322 | 323 | 324 | 325 | 326 | 327 | 328 | | | |
| 16 | 329 | 330 | 331 | 332 | 333 | 334 | 335 | 336 | 337 | 338 | 339 | 340 | 341 | 342 | 343 | 344 | 345 | 346 | 347 | 348 | 349 | 350 | 351 | | | |
| 17 | 352 | 353 | 354 | 355 | 356 | 357 | 358 | 359 | 360 | 361 | 362 | 363 | 364 | 365 | 366 | 367 | 368 | 369 | 370 | 371 | 372 | 373 | 374 | | | |
| 18 | | 375 | 376 | 377 | 378 | 379 | 380 | 381 | 382 | 383 | 384 | 385 | 386 | 387 | 388 | 389 | 390 | 391 | 392 | 393 | 394 | 395 | 396 | 397 | 398 | |
| 19 | | | 399 | 400 | 401 | 402 | 403 | 404 | 405 | 406 | 407 | 408 | 409 | 410 | 411 | 412 | 413 | 414 | 415 | 416 | 417 | 418 | 419 | 420 | 421 | |
| 20 | | | | 422 | 423 | 424 | 425 | 426 | 427 | 428 | 429 | 430 | 431 | 432 | 433 | 434 | 435 | 436 | 437 | 438 | 439 | 440 | 441 | 442 | 443 | |
| 21 | | | | 444 | 445 | 446 | 447 | 448 | 449 | 450 | 451 | 452 | 453 | 454 | 455 | 456 | 457 | 458 | 459 | 460 | 461 | 462 | 463 | 464 | 465 | |
| 22 | | | | | | | | | | | 466 | 467 | 468 | 469 | 470 | 471 | 472 | 473 | 474 | 475 | 476 | 477 | 478 | 479 | 480 | |
| 23 | | | | | | | | | | | 481 | 482 | 483 | 484 | 485 | 486 | 487 | 488 | 489 | 490 | 491 | 492 | 493 | 494 | 495 | |
| 24 | | | | | | | | | | | | | | | | | | | 496 | 497 | 498 | 499 | 500 | 501 | 502 | 503 |
| 25 | | | | | | | | | | | | | | | | | | | | | 504 | 505 | 506 | 507 | 508 | |
| 26 | | | | | | | | | | | | | | | | | | | | | | | | 509 | 510 | 511 |

APPENDIX C

| Index | Filter Coefficient Set (LSPs in Hz) | | | | | | | | | |
|---|---|---|---|---|---|---|---|---|---|---|
| 1 | 652 | 682 | 1261 | 1493 | 1650 | 1888 | 2468 | 2753 | 3111 | 3679 |
| | 631 | 682 | 1124 | 1410 | 1588 | 1980 | 2470 | 2665 | 3218 | 3724 |
| 2 | 631 | 682 | 1124 | 1410 | 1588 | 1980 | 2470 | 2665 | 3218 | 3724 |
| | 637 | 709 | 1097 | 1341 | 1550 | 1979 | 2664 | 2728 | 3191 | 3795 |
| 3 | 637 | 709 | 1097 | 1341 | 1550 | 1979 | 2664 | 2728 | 3191 | 3795 |
| | 620 | 694 | 1078 | 1303 | 1516 | 1993 | 2753 | 2842 | 3088 | 3720 |
| 4 | 620 | 694 | 1078 | 1303 | 1516 | 1993 | 2753 | 2842 | 3088 | 3720 |
| | 592 | 657 | 1015 | 1294 | 1510 | 1916 | 2751 | 2868 | 3016 | 3464 |
| 5 | 592 | 657 | 1015 | 1294 | 1510 | 1916 | 2751 | 2868 | 3016 | 3464 |
| | 362 | 632 | 1037 | 1294 | 1725 | 2269 | 2559 | 2818 | 3057 | 3627 |
| 6 | 630 | 849 | 1238 | 1589 | 1931 | 2215 | 2691 | 3011 | 3298 | 3642 |
| | 372 | 785 | 1071 | 1520 | 1849 | 2343 | 2802 | 2930 | 3385 | 3731 |
| . | . | . | . | . | . | . | . | . | . | . |
| . | . | . | . | . | . | . | . | . | . | . |
| . | . | . | . | . | . | . | . | . | . | . |
| 131,072 | 630 | 671 | 1217 | 1777 | 2076 | 2250 | 2640 | 2900 | 3075 | 3594 |
| | 372 | 663 | 1163 | 1730 | 2175 | 2342 | 2645 | 2934 | 3072 | 3585 |

APPENDIX D

| Voicing Decision of First Frame (V1) \ Voicing Decision of Second Frame (V2) | 0 | 1 |
|---|---|---|
| 0 | Case 1 (1024) | Case 3 (16,384) |
| 1 | Case 2 (2048) | Case 4 (111,616) |

APPENDIX E

| Sum Filter | | Difference Filter | |
|---|---|---|---|
| P(1) = 1. | | Q(1) = 1. | |
| P(2) = −[PC(1) + PC(10)] | | Q(2) = −[PC(1) − PC(10)] | |
| P(3) = −[PC(2) + PC(9)] | | Q(3) = −[PC(2) − PC(9)] | |
| P(4) = −[PC(3) + PC(8)] | | Q(4) = −[PC(3) − PC(8)] | |
| P(5) = −[PC(4) + PC(7)] | | Q(5) = −[PC(4) − PC(7)] | |
| P(6) = −[PC(5) + PC(6)] | | Q(6) = −[PC(5) − PC(6)] | |
| P(7) = −[PC(6) + PC(5)] | = P(6) | Q(7) = −[PC(6) − PC(5)] | = −Q(6) |
| P(8) = −[PC(7) + PC(4)] | = P(5) | Q(8) = −[PC(7) − PC(4)] | = −Q(5) |
| P(9) = −[PC(8) + PC(3)] | = P(4) | Q(9) = −[PC(8) − PC(3)] | = −Q(4) |
| P(10) = −[PC(9) + PQ(2)] | = P(3) | Q(10) = −[PC(9) − PC(2)] | = −Q(3) |
| P(11) = −[PC(10) + PC(1)] | = P(2) | Q(11) = −[PC(10) − PC(1)] | = −Q(2) |
| P(12) = 1. | = P(1) | Q(12) = −1. | = −Q(1) |

APPENDIX F

| Sum Filter | | Difference Filter | |
|---|---|---|---|
| PP(1) = 1. | | QQ(1) = 1. | |
| PP(2) = P(2) − PP(1) | | QQ(2) = Q(2) + QQ(1) | |
| PP(3) = P(3) − PP(2) | | QQ(3) = Q(3) + QQ(2) | |
| PP(4) = P(4) − PP(3) | | QQ(4) = Q(4) + QQ(3) | |
| PP(5) = P(5) − PP(4) | | QQ(5) = Q(5) + QQ(4) | |
| PP(6) = P(6) − PP(5) | | QQ(6) = Q(6) + QQ(5) | |
| PP(7) = P(7) − PP(6) | = PP(5) | QQ(7) = Q(7) + QQ(6) | = QQ(5) |
| PP(8) = P(8) − PP(7) | = PP(4) | QQ(8) = Q(8) + QQ(7) | = QQ(4) |
| PP(9) = P(9) − PP(8) | = PP(3) | QQ(9) = Q(9) + QQ(8) | = QQ(3) |
| PP(10) = P(10) − PP(9) | = PP(2) | QQ(10) = Q(10) + QQ(9) | = QQ(2) |
| PP(11) = 1. | = PP(1) | QQ(11) = 1. | = QQ(1) |

APPENDIX G

| Real-Root Removed Sum Filter | | Real-Root Removed Difference Filter | |
|---|---|---|---|
| PP(1) = 1. | | QQ(1) = 1. | |
| PP(2) = −[PC(1) + PC(10)] | − PP(1) | QQ(2) = −[PC(1) − PC(10)] | + QQ(1) |
| PP(3) = −[PC(2) + PC(9)] | − PP(2) | QQ(3) = −[PC(2) − PC(9)] | + QQ(2) |
| PP(4) = −[PC(3) + PC(8)] | − PP(3) | QQ(4) = −[PC(3) − PC(8)] | + QQ(3) |
| PP(5) = −[PC(4) + PC(7)] | − PP(4) | QQ(5) = −[PC(4) − PC(7)] | + QQ(4) |
| PP(6) = −[PC(5) + PC(6)] | − PP(5) | QQ(6) = −[PC(5) − PC(6)] | + QQ(5) |

APPENDIX G-continued

| Real-Root Removed Sum Filter | Real-Root Removed Difference Filter |
|---|---|
| PP(7) = PP(5) | QQ(7) = QQ(5) |
| PP(8) = PP(4) | QQ(8) = QQ(4) |
| PP(9) = PP(3) | QQ(9) = QQ(3) |
| PP(10) = PP(2) | QQ(10) = QQ(2) |
| PP(11) = PP(1) | QQ(11) = QQ(1) |

What is claimed is:

1. A voice communication processing system for processing a speech waveform as a digital bit stream, comprising:

transmitting means for converting the speech waveform into the digital bit stream and transmitting the digital bit stream by encoding speech parameters from the speech waveform into a reduced bit representation by joint encoding the speech parameters over frames in the digital bit stream; and receiving means for receiving the digital bit stream and converting the digital bit stream into a reproduced speech waveform by decoding the reduced bit representation in the digital bit stream into reproduced speech parameters in the reproduced speech waveform;

wherein said transmitting means includes a parameter encoder encoding an amplitude parameter by joint encoding amplitude table indices of the frames in the digital bit stream.

2. A voice communication processing system for processing a speech waveform as a digital bit stream, comprising:

transmitting means for converting the speech waveform into the digital bit stream and transmitting the digital bit stream by encoding speech parameters from the speech waveform into a reduced bit representation by joint encoding the speech parameters over frames in the digital bit stream; and receiving means for receiving the digital bit stream and converting the digital bit stream into a reproduced speech waveform by decoding the reduced bit representation in the digital bit stream into reproduced speech parameters in the reproduced speech waveform.;

wherein said transmitting means includes a parameter encoder encoding a pitch period by joint encoding pitch table indices being an average of the pitch period over the frames in the digital bit stream.

3. Encoding/decoding system in a voice communication processor converting a speech waveform into a digital bit stream, transmitting and receiving the digital bit stream, and converting the digital bit stream to a reproduced speech waveform, said encoding/decoding system comprising:

encoding means for encoding speech parameters from the speech waveform into a reduced bit representation by joint encoding the speech parameters over frames in the digital bit stream; and decoding means for decoding the digital bit stream into reproduced speech parameters used for generating the reproduced speech waveform;

wherein said encoding means includes a parameter encoder encoding an amplitude parameter by joint encoding amplitude table indices of the frames in the digital bit stream.

4. Encoding/decoding system in a voice communication processor converting a speech waveform into a digital bit stream, transmitting and receiving the digital bit stream, and converting the digital bit stream to a reproduced speech waveform, said encoding/decoding system comprising:

encoding means for encoding speech parameters from the speech waveform into a reduced bit representation by joint encoding the speech parameters over frames in the digital bit stream; and decoding means for decoding the digital bit stream into reproduced speech parameters used for generating the reproduced speech waveform;

wherein said encoding means includes a parameter encoder encoding a pitch period by joint encoding pitch table indices being an average of the pitch period over the frames in the digital bit stream.

5. A method of processing a speech waveform as a digital bit stream, comprising the steps of:

a) converting the Speech waveform into the digital bit stream and transmitting the digital bit stream by encoding speech parameters from the speech waveform into a reduced bit representation by joint encoding the speech parameters over frames in the digital bit stream; and b) receiving the digital bit stream and converting the digital bit stream into a reproduced speech waveform by decoding the digital bit stream into reproduced speech parameters in the reproduced speech waveform;

wherein step a) includes:

a1) obtaining an amplitude parameter from the speech waveform for each of the frames;

a2) performing a look-up operation of an amplitude table to obtain an amplitude table index for each of the frames corresponding to the amplitude parameter; and a3) joint encoding the amplitude table indices over the frames.

6. A method of processing a speech waveform as a digital bit stream, comprising the steps of:

a) converting the speech waveform into the digital bit stream and transmitting the digital bit stream by encoding speech parameters from the speech waveform into a reduced bit representation by joint encoding the speech parameters over frames in the digital bit stream; and b) receiving the digital bit stream and converting the digital bit stream into a reproduced speech waveform by decoding the digital bit stream into reproduced speech parameters in the reproduced speech waveform;

wherein step a) includes:

a1) obtaining a pitch period from the speech waveform for each of the frames;

a2) performing a look-up operation of a pitch table to obtain a pitch table index for each of the frames corresponding to an average of the pitch period over the frames, and a3) joint encoding the pitch table indices over the frames.

7. A voice communication processing system for processing a speech waveform as a digital bit stream, comprising:

transmitting means for converting the speech waveform into the digital bit stream and transmitting the digital bit stream by encoding speech parameters from the speech waveform into a reduced bit representation by joint encoding the speech parameters over frames in the digital bit stream; and receiving means for receiving the digital bit stream and converting the digital bit stream into a reproduced speech waveform by decoding the reduced bit representation in the digital bit stream into reproduced speech parameters in the reproduced speech waveform;

wherein said transmitting means further comprises:

prediction coefficient generating means for receiving the speech waveform and the generating prediction coefficients responsive to the speech waveform;

coefficient generating means for generating coefficients of real-root removed sum and difference filters responsive to the prediction coefficients using polynomial division and for generating sine and cosine coefficients;

a storage table connected to said transforming means and storing the sine and cosine coefficients as stored sine and cosine coefficients; and spectrum generating means for generating spectrum coefficients by transforming the coefficients using the stored sine and cosine coefficients and for determining line spectrum pairs for generating the reproduced speech waveform by determining which of the spectrum coefficients have a null frequency using a parabolic fitting.

8. A voice communication processing system according to claim 7, wherein said coefficient generating means decomposes a linear predictive coefficient analysis filter used to represent the speech waveform into sum and difference filters and removes extraneous roots of each of said sum and difference filters to generate the coefficients of the real-root removed sum and difference filters.

9. A voice communication processing system according to claim 7, further comprising a formula register connected to said coefficient generating means, and wherein said coefficient generating means generates coefficient formulas which are stored in said formula register, the coefficients determined by the coefficient formulas.

10. A method of processing a speech waveform as a digital bit stream, comprising the steps of:

a) converting the speech waveform into the digital bit stream and transmitting the digital bit stream by encoding speech parameters from the speech waveform into a reduced bit representation by joint encoding the speech parameters over frames in the digital bit stream; and b) receiving the digital bit stream and converting the digital bit stream into a reproduced speech waveform by decoding the digital bit stream into reproduced speech parameters in the reproduced speech waveform;

wherein step a) includes a1) receiving the speech waveform and generating prediction coefficients responsive to the speech waveform;

a2) generating coefficients of real-root removed sum and difference filters responsive to the prediction coefficients using polynomial division and generating sine and cosine coefficients;

a3) storing the sine and cosine coefficients in a storage table as stored sine and cosine coefficients;

a4) generating spectrum coefficients by transforming the coefficients using the stored sine and cosine coefficients; and a5) determining line spectrum pairs for generating the reproduced speech waveform by determining which of the spectrum coefficients have a null frequency using a parabolic fitting.

11. A method according to claim 10, wherein step a) further includes before said generating step a2) , the steps of:

(1) decomposing a linear predictive coefficient analysis filter used to represent the speech waveform into sum and difference filters; and (2) removing extraneous roots of each of said sum and difference filters to generate the coefficients of the real-root removed sum and difference filters.

12. A method according to claim 10, wherein step a2) further comprises the step of generating coefficient formulas which are stored in a formula storage table, the coefficients determined by the coefficient formulas.

13. A method for transforming prediction coefficients to line spectrum pairs, comprising the steps of:

a) generating prediction coefficients responsive to a speech waveform;

b) generating coefficients of real-root removed sum and difference filters responsive to the prediction coefficients using polynomial division and generating sine and cosine coefficients;

c) storing the sine and cosine coefficients in a storage table as stored sine and cosine coefficients;

d) generating spectrum coefficients by transforming the coefficients using the stored sine and cosine coefficients; and e) determining line spectrum pairs for generating a reproduced speech waveform by determining which of the spectrum coefficients have a null frequency using a parabolic fitting.

14. A method according to claim 13, further including before said generating step b), the steps of:

(1) decomposing the linear predictive coefficient analysis filter into sum and difference filters; and (2) removing extraneous roots of each of said sum and difference filters to generate the coefficients of the real-root removed sum and difference filters.

15. A method according to claim 13, wherein step a) further comprises the step of generating coefficient formulas which are stored in a formula storage table, the coefficients determined by the coefficient formulas.

16. A converter transforming prediction coefficients to line spectrum pairs, comprising:

prediction coefficient generating means for receiving a speech waveform and for generating prediction coefficients responsive to the speech waveform;

coefficient generating means for generating coefficients of real-root removed sum and difference filters responsive to the prediction coefficients using polynomial division and for generating sine and cosine coefficients;

a storage table connected to said transforming means storing the sine and cosine coefficients as stored sine and cosine coefficients; and spectrum generating means for generating spectrum coefficients by transforming the coefficients using the stored sine and cosine coefficients and for determining line spectrum pairs for generating a reproduced speech waveform by determining which of the spectrum coefficients have a null frequency using a parabolic fitting.

17. A converter according to claim 16, wherein said coefficient generating means decomposes a linear predictive coefficient analysis filter used to represent the speech waveform into sum and difference filters and removes extraneous roots of each of said sum and difference filters to generate the coefficients of the real-root removed sum and difference filters.

18. A converter according to claim 16, further comprising a formula register connected to said coefficient generating means, and wherein said coefficient generating means generates coefficient formulas which are stored in said formula register, the coefficients determined by the coefficient formulas.

* * * * *